United States Patent [19]

Cook

[11] 4,106,159

[45] Aug. 15, 1978

[54] LATCHING HINGE FOR KILNS

[75] Inventor: Ronald Janney Cook, Dubuque, Iowa

[73] Assignee: Sybron Corporation, Rochester, N.Y.

[21] Appl. No.: 820,515

[22] Filed: Aug. 1, 1977

[51] Int. Cl.[2] ..... E05D 11/10

[52] U.S. Cl. ..... 16/146; 220/85 CH; 220/335

[58] Field of Search ..... 16/139, 142–147, 16/177, 169; 220/335, 85 CH; 49/386

[56] References Cited

U.S. PATENT DOCUMENTS

| | | | |
|---|---|---|---|
| 1,720,789 | 7/1929 | Heusser | 220/335 |
| 2,689,970 | 9/1954 | Pirz | 16/146 |
| 3,003,410 | 10/1943 | Shaw et al. | 16/143 X |

*Primary Examiner*—James Kee Chi

*Attorney, Agent, or Firm*—Theodore B. Roessel; Roger Aceto

[57] ABSTRACT

A hinge includes a spring biased rod which is biased towards a supporting bracket. When the hinge is rotated to a certain position, the biased rod drops into a notch located on the supporting bracket. This arrangement, retains the lid of a kiln in an open position relative to the body of the kiln.

1 Claim, 3 Drawing Figures

LATCHING HINGE FOR KILNS

BACKGROUND OF THE INVENTION

This invention relates to a hinge for kilns and more particular is concerned with a latching hinge for retaining a kiln lid in open position. A common design of a kiln calls for a high temperature oven having a vertical well. After goods are inserted in the well, a heat retaining lid is closed upon the oven. The lid is fairly heavy and it is desirable to pivot the lid about the oven container and to temporarily lock the lid in an open position when goods are to be inserted into the oven.

A well-known way to do this is to provide chains connecting the container with the lid so when the lid is opened passed the vertical, the chains retain the lid from dropping back. The chains, however, block access from the side of the oven and do not provide a positive locking feature. Another way to retain the lid in an open position is to use the so-called bird lock, wherein a hooked member snaps over a rod. This has the disadvantage of being hard to release. It is therefore the object of this invention to provide a past center lock to retain a lid in open position while allowing easy release.

DESCRIPTION OF THE INVENTION

Figure 1:
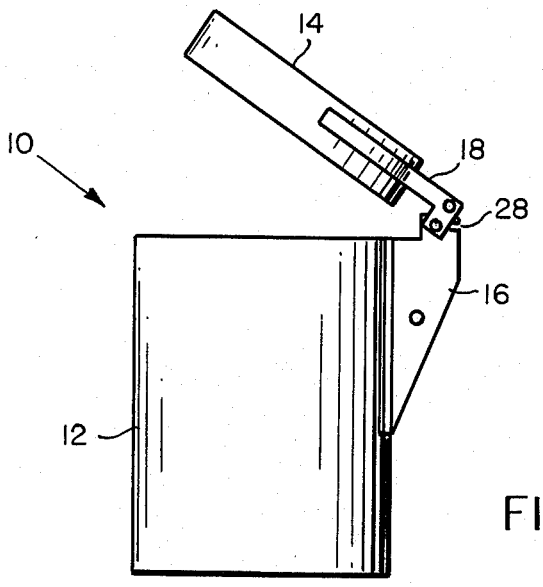
FIG. 1, shows a kiln container and cover connected by a hinge according to the invention.

Shown in FIG. 1 is a kiln 10 having a container 12 and a lid 14 for the container. Protruding from the back of container 14 are two brackets 16 and projecting from the lid 14 are two tabs, 18.

Figure 2:
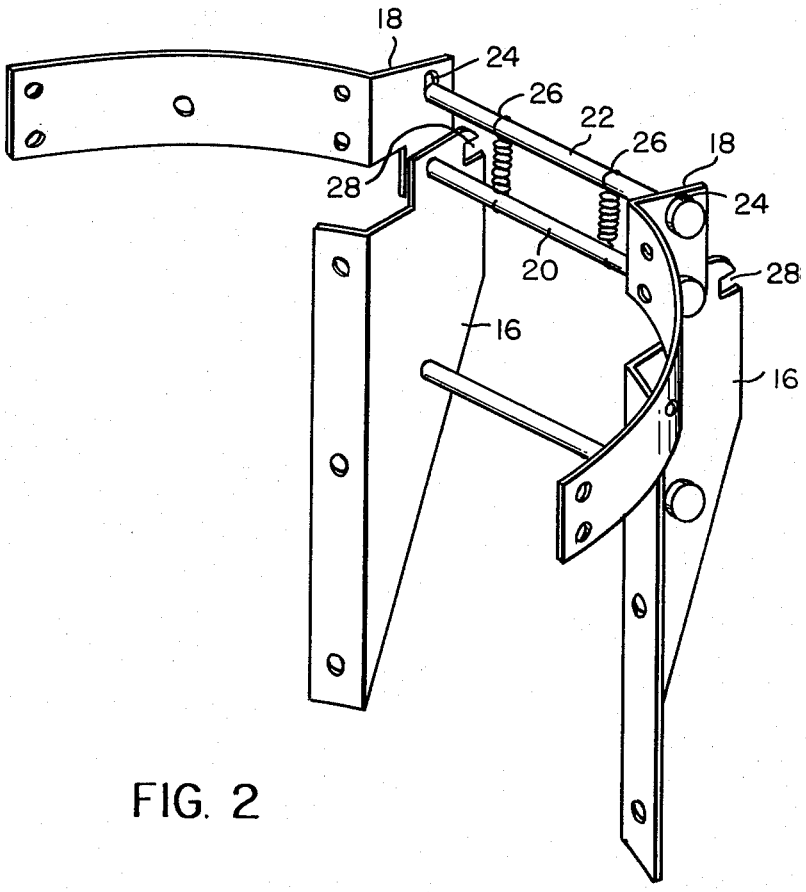
FIG. 2, is a detailed drawing of the hinge in closed position.

As seen in FIG. 2, the lid tabs 18 are pivotly attached to the brackets 16 by means of a pivot rod 20, which passes through the two tabs 18. A latching rod 22 is passed between the two tabs, each tab having a slot 24 to allow movement of the latching rod 22. One or more springs 26 bias the latching rod 22 towards the pivot rod 20. A notch 28 is provided upon the surface of each bracket 16.

Figure 3:
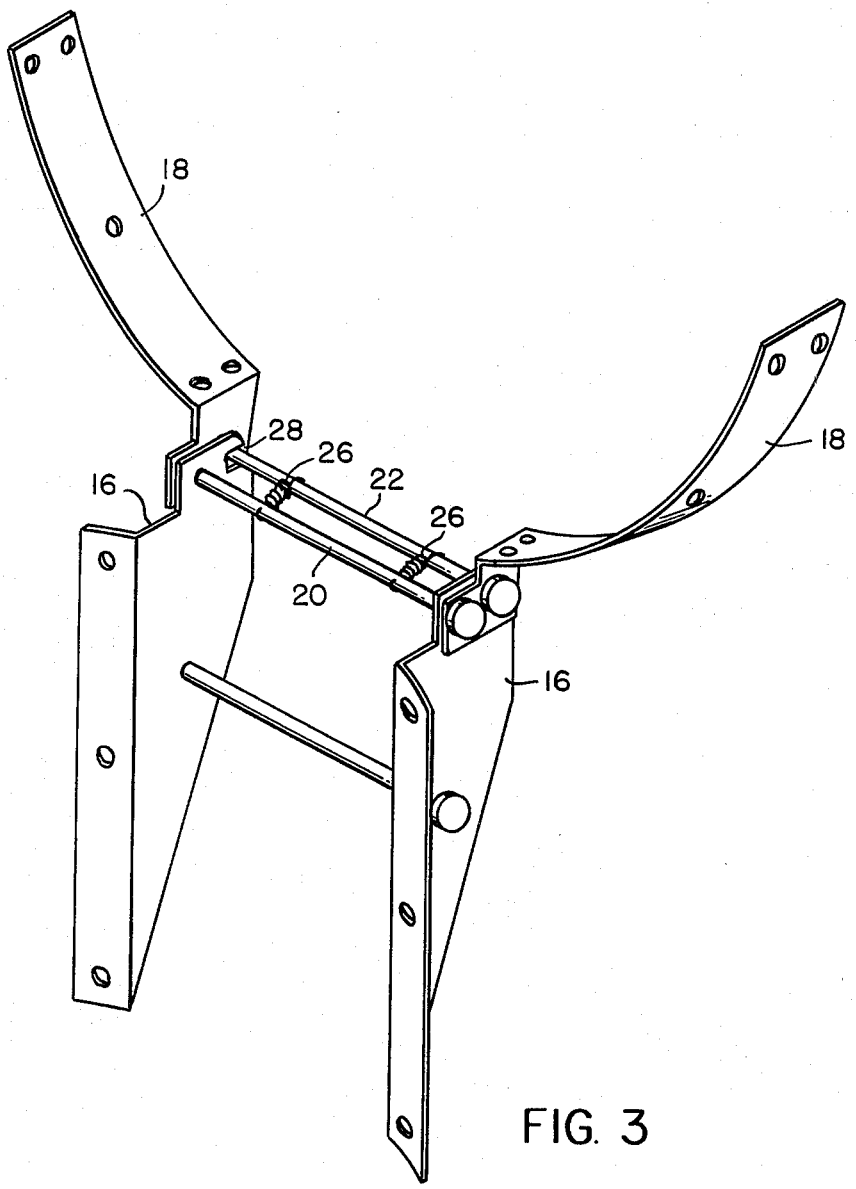
FIG. 3 is a detailed drawing of the hinge in open position.

As shown in FIG. 3, when the lid is in the open position, the latching rod 22, being biased, latches into the notches 28 thereby holding the lid open. This arrangement provides a positive lock preventing accidental closing of the lid and at the same time, being of minimal interference to access to the kiln. The lock is easy to release by lifting the latching rod from the notches.

I claim:

1. A latching hinge for retaining a kiln lid in an open position in relation to a kiln container, comprised of:

at least one bracket secured to said container;

at least one tab secured to said lid;

a pivot connecting said bracket and said tab while allowing rotation of said tab when said lid is being opened or closed;

said tab having a slot;

a latching rod retained by said slot;

at least one spring biasing said rod towards said bracket; and said bracket having a notch along its periphery arranged so that when said lid is in an open position said latching rod engages said notch.

* * * * *